United States Patent [19]

Brown

[11] Patent Number: 4,800,657

[45] **Date of Patent: * Jan. 31, 1989**

[54] VARIABLY ADJUSTABLE SHOE INSERT

[76] Inventor: Dennis N. Brown, 8525 Custer School Rd., Custer, Wash. 98240

[ * ] Notice: The portion of the term of this patent subsequent to Nov. 8, 2000 has been disclaimed.

[21] Appl. No.: 899,967

[22] Filed: Aug. 25, 1986

Related U.S. Application Data

[63] Continuation of Ser. No. 785,574, Oct. 8, 1985, abandoned, which is a continuation of Ser. No. 677,820, Dec. 3, 1984, abandoned, which is a continuation of Ser. No. 324,820, Nov. 25, 1981, abandoned.

[51] Int. Cl.[4] ..... A43B 13/38

[52] U.S. Cl. ..... 36/44; 36/91; 36/115; 128/581

[58] Field of Search ..... 36/88, 92, 93, 97, 114, 36/43, 44, 81, 28, 69, 71, DIG. 2; 128/581, 591, 594, 595, 596

[56] References Cited

U.S. PATENT DOCUMENTS

| | | | |
|---|---|---|---|
| 1,741,419 | 12/1929 | Jones | 36/43 X |
| 2,348,300 | 5/1944 | Klaus | 36/DIG. 2 |
| 2,403,442 | 7/1946 | Klaus | 36/DIG. 2 |
| 2,885,797 | 5/1959 | Chrencik | 36/92 X |
| 3,416,245 | 12/1968 | Ferreira | 36/44 |
| 3,601,908 | 8/1971 | Gilkerson | 36/43 |
| 4,232,457 | 11/1980 | Mosher | 36/44 |
| 4,237,626 | 12/1980 | Brown | 36/43 |
| 4,338,734 | 7/1982 | Schwartz | 36/44 |
| 4,364,188 | 12/1982 | Turner et al. | 36/91 |
| 4,364,189 | 12/1982 | Bates | 36/31 |
| 4,413,430 | 11/1983 | Brown | 36/44 |
| 4,423,735 | 1/1984 | Comparetto | 128/594 |
| 4,441,499 | 4/1984 | Comparetto et al. | 128/595 |
| 4,503,576 | 3/1985 | Brown | 36/43 X |
| 4,510,700 | 4/1985 | Brown | 36/44 |
| 4,513,518 | 4/1985 | Jalbert et al. | 36/43 X |
| 4,520,580 | 6/1985 | Brown | 36/44 |
| 4,597,196 | 7/1986 | Brown | 36/43 X |

FOREIGN PATENT DOCUMENTS

| | | | |
|---|---|---|---|
| 2445138 | 8/1980 | France | 36/97 |
| 508720 | 1/1955 | Italy | 36/43 |

*Primary Examiner*—Jimmy G. Foster

*Attorney, Agent, or Firm*—Hughes, Cassidy & Multer

[57] ABSTRACT

Disclosed herein is an insert for a shoe, boot, or the like which is capable of plural adjustments so as to adapt the insert to the unique physical conformation of the wearer's foot, to hold the foot in a neutral axis position substantially at all times, to return a foot into the neutral axis mode automatically, and to provide a wide range of support, resiliency, and angulation based on the needs of the user. The device as set forth lends itself to modification for various sports where lateral motion is of primary importance, shock absorption and longitudinal extension of the foot is of paramount importance, or for geriatric patients whereby a single insert and the modifying devices associated therewith address the vast spectrum of orthotic needs.

10 Claims, 4 Drawing Sheets

2
2
3
3
4
7
8
9
10
13
14
15
16
18
19
22
23

2
16
17

1
2
4
5
10
11
12
21
24

VARIABLY ADJUSTABLE SHOE INSERT

CROSS REFERENCE TO RELATED APPLICATIONS

This is a continuation application of Ser. No. 785,574 filed Oct. 8, 1985, which is a continuation application of Ser. No. 677,820 filed Dec. 3, 1984, which is a continuation application of Ser. No. 324,820 filed Nov. 25, 1981.

BACKGROUND OF THE INVENTION

This invention relates generally to orthotic appliances.

Fairly recently, greater attempts have been made to provide footwear which is anatomically correct so as to not only increase the comfort of the wearer, but also to minimize fatigue and injuries. This requires an analysis of the typical human gait. When one is moving substantially in a single linear direction, the gait consists of three distinct phases. First, the heel strike phase occurs during which the foot is essentially a "mobile adapter" ready to conform to the topographical contours encountered. Second, the transistion of mid-gait phase transforms the mobile adapter into a "rigid lever" where the mid-tarsal joint becomes locked preparing the foot for translation of the accumulated forces in a stable manner throughout the foot during the remainder of said cycle and the impact forces are dissipated through the ankle and leg bones to the upper torso. Third, the "toe roll" phase finishes the gait cycle and the next step is begun. The critical phase is the mid-gait or transition phase where the foot is transformed from a "mobile adapter" to a "rigid lever". The optimum configuration for the ankle at this point is to have the subtalar joint in a neutral position as the mid-tarsal joint becomes locked and the foot becomes a "rigid lever". This allows the impact load to be properly dissipated. While podiatrists have long been aware of the need to maintain the foot's proper orientation relative to the leg to provide "rigid lever" and accordingly have prescribed orthoses for that purpose, the general populous rarely avails themselves of these services until after a certain amount of discomfort and/or damage has been done.

The following patents reflect the state of the art of which applicant is aware in so far as these patents appear to be germane to the patent process:

| | | | |
|---|---|---|---|
| 2,669,814 | Ritchey | 1,240,066 | French-Strasbach |
| 2,680,919 | Riggs | 465,940 | British-King |
| 3,922,801 | Zente | | |

Of these, the patent to Ritchey appears to be of great interest since he teaches the use of an orthopedic device suitably positioned within a shoe or the like, in which the upper surface thereof has a complex contour addressed to the peculiarities of a given foot. The instant invention can be contrasted over this prior art by noting the contrasting ease with which the apparatus according to the instant application can be initially fitted to a person, or successively fitted as a function of time, while providing immediate relief.

Similarly, the patent to Riggs teaches the use of an insole type appliance having a compound contour like the Ritchey invention configured in such a manner as to provide foot relief based on Rigg's perception of a universal foot disorder.

Similarly, the Zente patent teaches the use of a liquid filled orthopedic apparatus comprised of a plurality of discrete internal liquid filled ampules which are strategically placed between upper and lower laminae and sealed in place to provide separate support for various parts of the foot.

The remaining references show the state of the art further, the British patent teaching the use of an insert having a compound contour based on the inventor's attempts at defining a single insert for addressing a wide spectrum of problems.

SUMMARY AND OBJECTS OF THE INVENTION

By way of contrast, the instant application is directed to and specifies an orthotic appliance adapted to be placed as an insert within a shoe, boot, or the like formed initially as a blank having an upper surface that generally follows the contour of the plantar surface of a foot. Thereafter, on a bottom portion of the appliance, means defining recesses having various dimensions are provided, all of which are adapted to have inserted therewithin plugs, finger like members, or absorptive pads capable of different degrees of resilience so that such as insert can be modified to "fine tune" the insert to accommodate the wearer. Specifically, resilient fingers disposed within certain areas, and certain plugs are adapted to beneficially distort the upper surface contour of the insert so as to provide an identical correspondence with the plantar surface of a foot, and in addition to provide beneficial angulation of the foot as may be desired, and in addition to encourage the foot to remain and return to a neutral position in which the proper alignment is provided between the leg and the foot so as to encourage a uniform force distribution and dissipation throughout the bone structure of the foot and of the leg, thereby minimizing unwanted torsion etc. a frequent cause of discomfort or injury. Additionally, the contour of the insert can be modified to accommodate and support any patient but especially the geriatric, patients so that by specially modifying the cuboid and shaft on the lateral metatarsal areas of the foot or anywhere else along the lateral aspect of the foot to provide relief of pressures. Similarly the contour along the medial arch area or, along the medial aspect of the foot may be accommodated and supported. Such accommodation and support along the medial and lateral segments of the foot are frequently necessary in all age groups but especially, with the geriatrics. Moreover, the device according to the present invention is provided with a recessed area on the bottom face thereof so that force applied by the foot onto the insert encourages greater support of the foot, and the natural elongation of the foot during a walking or running mode can be beneficially accommodated by the dynamic characteristics of the insert in which longitudinal elongation of the foot during its flexure is taken into account by the insert geometry.

An additional preferred form of the invention provides an orthotic insert formed from two pieces, one piece running substantially the length of the foot, similar to the first embodiment, and a second piece serving as a cap which underlies and is removably affixed to the first piece not only for ease of manufacture, but also for an additional degree of freedom. In this embodiment, some of the plug members may be formed and carried along the initial blank, and score lines are provided for separation from the blank so as to reduce manufacturing costs.

Thus, it is a primary object of this invention to provide an orthotic insert that is to be disposed within a shoe, boot or the like whose contour and angulation can be modified initially and incrementally thereafter in an iterative process so as to support the foot properly and encourage correct relative bone orientation.

It is yet a further object of this invention to provide a device of the character described above which is relatively inexpensive to manufacture, extremely durable in construction, safe to use, and lends itself to mass production techniques.

It is yet a further object of this invention to provide a device of the character described above in which plural adjustments can be affected in order to address a wide spectrum of orthopedic problems.

It is still a further object of this invention to provide a device of the character described above which is so configured as to lend itself by adaptation to a plurality of specific needs (walking, running, basketball, tennis, etc.) specifically by the plural alternations available.

It is still a further object of this invention to provide a device of the character described above which encourages a proper orientation of the foot, its associated bones, relative to the leg in such a manner that the weight distribution is substantially uniform along the longitudinal axis of the foot based upon the individual foot components' weight bearing capabilities.

It is an object of the invention to provide a device which assists in orienting the sub-talar joint so as to be more aligned towards the neutral position, the mid tarsal joint also in its more functional position, that is locked.

These and other objects will become manifest when considering the following detailed specification when taken in conjunction with the appended drawing figures.

BRIEF DESCRIPTION OF THE DRAWING FIGURES

DESCRIPTION OF THE PREFERRED EMBODIMENT

Figure 1:
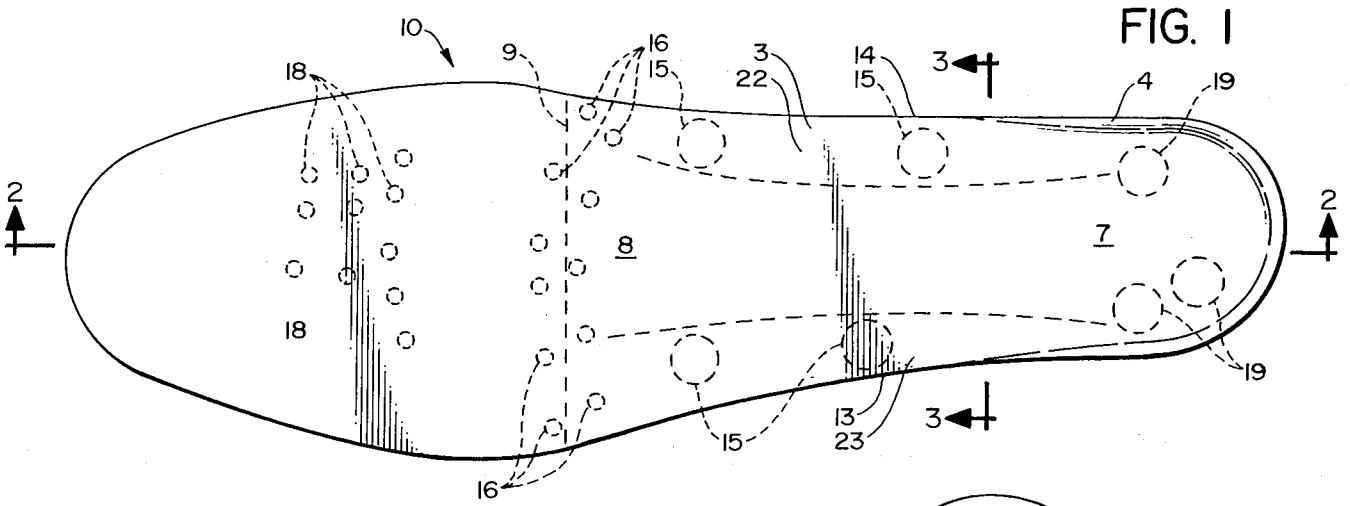
FIG. 1 is a top plan view of the apparatus according to the present invention.
Figure 4:
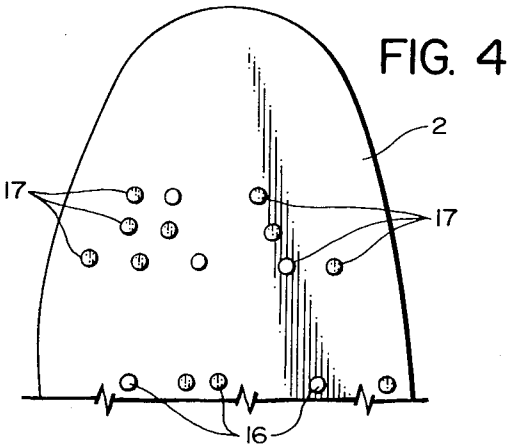
FIG. 4 is a bottom plan view of the forward portion shown in FIG. 1.

Referring to the drawings now wherein like reference numerals refer to like parts throughout the various drawing figures, reference numeral 10 is directed to the orthotic insert according to the present invention.

The insert 10 is formed initially as a blank having a top surface 1 formed from an abrasion resistant padded material such as a synthetic fabric, nylon, dacron, felt, cloth and a resilient underlying pad 21 of rubber or the like which is affixed to a lower portion 2 by means of adhesion or fusion. The lower portion 2 is preferably formed from a foamed material such as Freelen®, Plastizote®, or any open or closed cell foams characterized in being relatively resilient, having sufficient memory to return to its original state when unstressed, and capable of moderate shock absorption properties.

Specifically, the top surface 1 reflects the contour of a top surface of the lower portion 2 and includes an arch support area 3 of raised dimension, a depressed heel cup area 7, and a heel supporting rim or lip 4 which surrounds the heel in a manner to be defined shortly.

The bottom surface 2 of the insert is provided with an elongate rectangular recess 5 extending substantially from the calcaneal area 7 of the foot up to the cuboid and lateral matatarsal areas 8, the transition of the recess along the longitudinal axis having a substantially beveled edge 6 so that a smooth transition between the normal undersole 2 and the recess 5 along the longitudinal axis is provided. The lateral edges 24 of the recess are provided with an abrupt drop-off so that when the foot applies forces onto the insert, the distortion of the insert that takes place occurs along a central longitudinal axis whereby the foot at that area translates vertically downwardly to a greater extent than along the edges of the heel due to recess 5, and a minor distortion of the insert occurs so that the peripheral heel support area 4 turns in slightly and grasps the heel of the person somewhat more greatly, this heel cupping effect is enhanced by foot elongation, which occurs during the heel strike phase of the gait cycle when the foot elongates and becomes somewhat more narrow allowing emphasis of the deformation of the lip 4.

Figure 3:
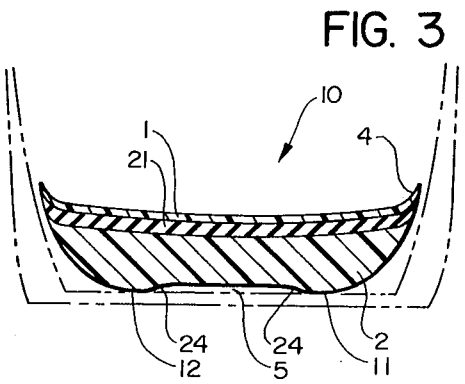
FIG. 3 is a sectional view taken along lines 3—3 of FIG. 1 showing the application of the orthotic in a shoe as an example.
Figure 2:
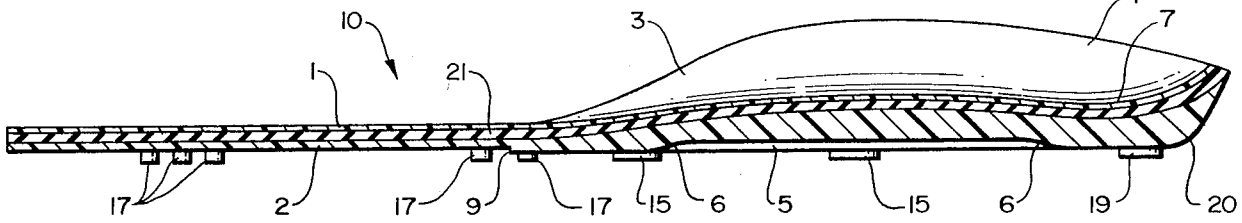
FIG. 2 is a sectional view taken along lines 2—2 of FIG. 1.

The insert is provided with a medial edge 14, a lateral edge 13 so as to provide two strips: a medial strip 11 and a lateral strip, 12 about the recess 5 and between edges 24, 13 and 14. These strips 11,12 underlie upper zones 22 and 23 and are provided with a plurality of holes so that plugs may be frictionally disposed therein. These plugs 15 define inserts for controlling height, will increase or decrease the long or medial arch, and can adjust calcaneal inclination. The lateral strip 12 as shown includes the ability to protect the subluxed cuboid by its proximate position thereto, thus during the transitional or mid-gait phase of the gait cycle these strips 11, 12 and their associated plugs 15 ensure the proper alignment of the sub-talor joint in a neutral position as the mid-tarsal joint becomes locked and the "mobile adapter" becomes a "rigid lever". Furthermore, these plugs can be deployed and adjusted to tune the insert for certain types of activities involving extensive lateral movement such as racquetball or tennis where the impact loads are often placed on the areas of the foot overlying these strips 11, 12. Accordingly, by selecting plugs of appropriate resiliency and geometrical configuration based on specific needs, the device enables one to cradle, cushion, and continuously realign the foot on the long axis thereof. Note the depiction in FIG. 3 in which the insert is aligned to the shoe's longitudinal axis for example, which provides one application assuring proper alignment for greater responsiveness. As shown, the strips 11 and 12 have a somewhat curved contour to assist in the beneficial deformation about the recess 5, thereby "rolling" the lip 4 up about the foot.

Additionally however, the righthand portion (FIG. 1) of the insert which is indicative of the back 20 of the heel is provided with a plurality of similar recesses and associcated plugs 19 therefore which are advantageously deployed at this area and disposed to serve as shock absorber inserts. These can be coded with different durometric values to aid function in gait and jogging, basketball, and in any sport. In fact, the choice of materials for this area lends itself to improved results when running or walking in this manner.

Reference numeral 9 is directed to the general region where the cuboid and metatarsal bases meet and a minor ridge 9 is provided on the bottom surface 2 of the sole along this area to correspond to the general anatomy of most people regarding flex. However, among geriatric patients this area is frequently susceptible to pressures along the lateral segment of the foot as well as the matatarsal heads and by the apparatus according to the instant application the pressures can be relieved by selectively building up areas adjacent the pressures sensitive heads so as to relieve the pressure. Specifically, a plurality of apertures 16 are disposed on the bottom face of the insert and adapted to be frictionally forced therewithin a plurality of fingers 17, the fingers preferably being slightly oversized relative to the holes to assure their exact placement. As with the plugs, these fingers 17 can be replaceable with varying degrees of density so as to customize the shock absorption as required.

Similarly, a plurality of holes 18 are provided forward of the metatarsal area, preferably in the area between the ball of the foot and the toes, these apertures 18 suitably dimensioned to receive by frictional fit similar fingers 17, the disposition of which therewithin will cause a raised area on the top surface of the insert so as to provide a purchase area for the toes, commonly known as toe cresting so as to have the top surface of the insert follow as closely as possible the contour of the foot. Furthermore, these fingers 17, help maintain the neutral position of the sub-talar joint during the final or "toe rolling" phase of the gait cycle.

As pointed out hereinbefore, the plugs and fingers can be made of varying degrees of density to lend themselves to adaptation in many environments, and it is believed that a plug or finger made from Sorbathane*TM* lends itself quite well to one specific application of these plugs and fingers.

Typically, a person desiring to improve the load distribution, support and orientation of his feet will take the insert as described hereinbefore and adjust the calcaneal inclination at area 7 anywhere from zero to 22 degrees through plugs 19 as would be determined by known techniques. Thereafter, a plurality of different plugs 19 would be available so that after initialization of the insert as by exercising, running, walking, etc, various iterative modifications in the toe cresting or other areas can be effected by the individual himself to take into account whatever type of endeavor is to be undertaken. For example, if one should desire to engage in running of one form or other, the plugs 19 may be replaced with ones having greater resilience, and conversely if one were to engage in a sport entailing lateral shock loads as in tennis or racquetball, the plugs 15 on the strips 11, 12 on either side of the recess 5 can be altered to accentuate the recess 5. Additionally, it should be appreciated that a pad or an appropriately dimensioned larger "plug" can be placed within the recessed area 5 to alter the amount of deformation the shoe undergoes should it be desirable. In this regard, the lower portion 2 at the recess area 5 can be so formed as to create a "zone of lesser resilience". In such an event, the recess can be dimensioned smaller or non-existant in which case the gradation in the lower portion's resilience at area 5 provides the deformation. Additionally, it should be observed from the foregoing that the plugs while generally, described and shown as being in cylindrical configuration can in fact have any type of contour and is therefore not seen to be a limitation. The plugs may have angulated top faces, proximate to the top surface 1 for further contouring. For example, the heel plugs 19 can be dimensioned for heel posting and lifting.

A second preferred form of the invention, shown in FIGS. 5 through 9 detail lends itself especially well to mass production techniques with a minimal amount of complex die tooling, and will now be described solely by the differences between the instant embodiment and that which was previously discussed.

Figure 5:
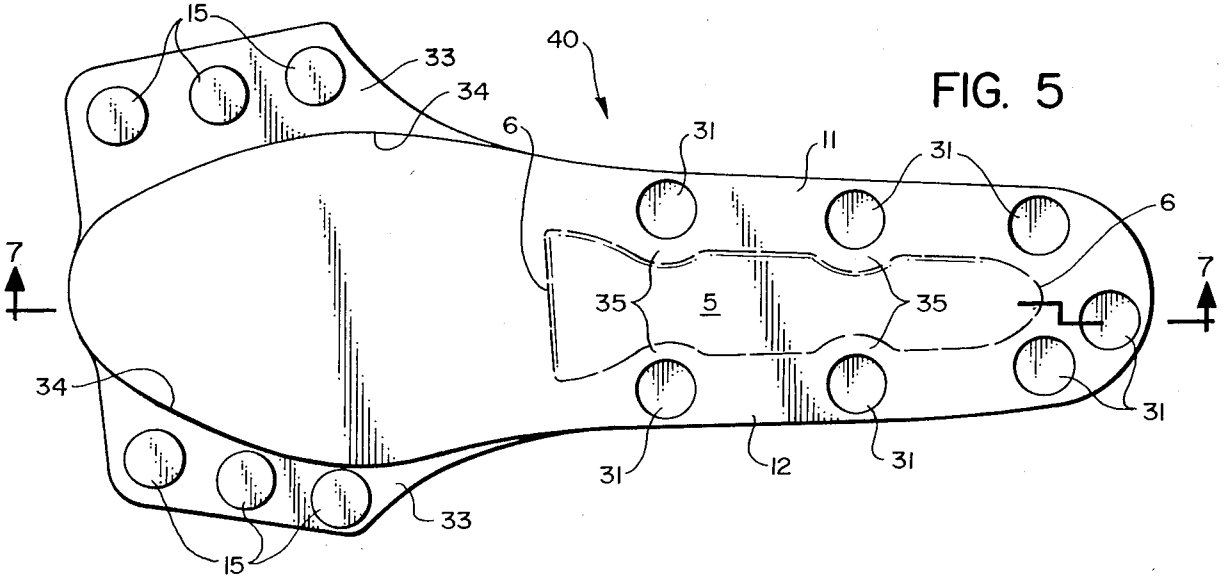
FIG. 5 is a bottom plan view of a top portion of a second form of the invention.
Figure 6:
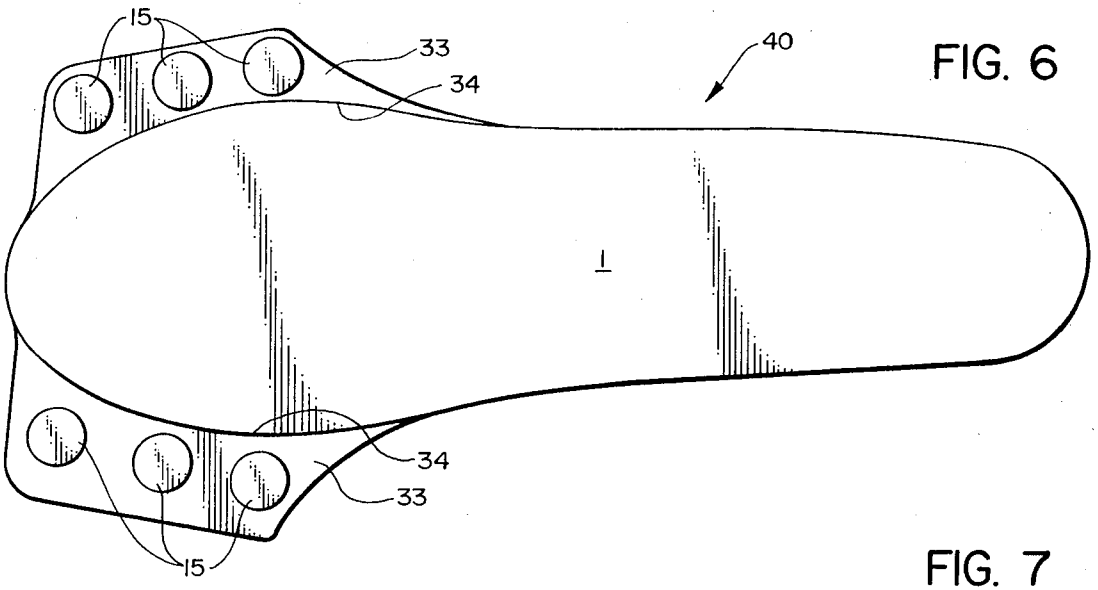
FIG. 6 is a top plan view of that which is shown in FIG. 5.

As shown in FIGS. 5 and 6, the blank 40 forms a top piece having generally the same attributes as the previously discussed embodiment, that is a recess 5 having a feathered leading and trailing edge, etc. The bottom face (FIG. 5) discloses a plurality of holes 31 disposed about the recess, the recess 5 having thickened areas 35 extending into the recessed area so that the medial and lateral strips 11 and 12 have additional surface area to respond beneficially to the plugs that are to be disposed therein which will now be explained. The forward portion of the first piece 40 includes a score line 34 allowing a marginal web portion 33 to be separable therefrom as by bending and thereafter fracturing, and it is within the web portion that the plugs 15 can be disposed and therefore provided all in one manufacturing process.

Figure 7:
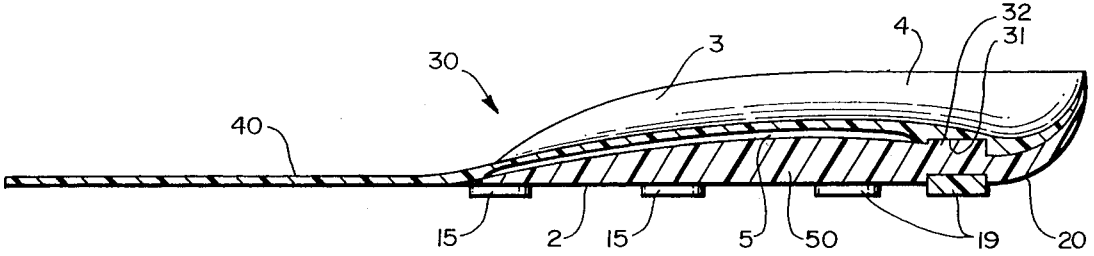
FIG. 7 is a partial sectional view taken along lines 7—7 of FIG. 5.
Figure 8:
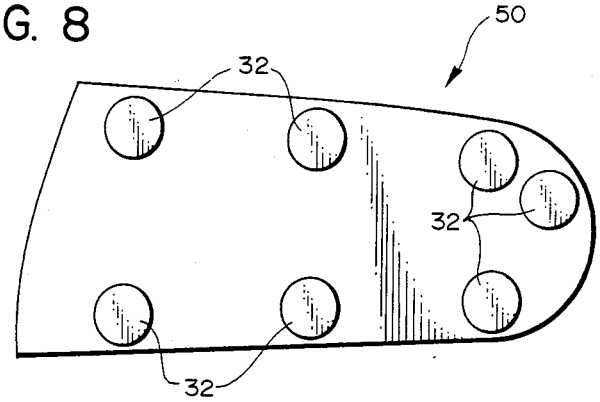
FIG. 8 is a top plan view of the cap portion of the insert according to the second preferred embodiment adapted to engage the bottom surface of that which is shown in FIG. 5.
Figure 9:
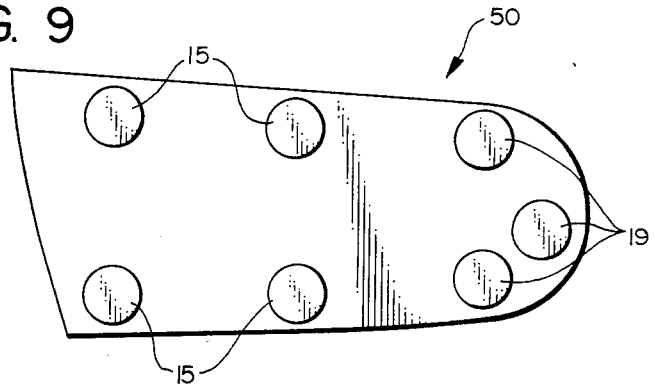
FIG. 9 is a bottom plan view of the cap of FIG. 8.

As shown in FIGS. 8 and 9, a plurality of upwardly extending interlocking lugs 32 are provided on a top face of the second piece 50, the locking lugs adapted to be received within the holes 31 of FIG. 5. Thus, as shown in FIG. 7, the appliance 30 according to the second form of the invention is defined by a cap forming a second piece 50, a first piece 40 which engages the plantar portion of a person's foot, each first and second pieces are relatively separable and joinable by the friction fit of the locking lugs 32 into their respective holes 31. In this manner, the recess 5 can contain therein a shock absorbing material of different resilience, or no absorber at all as is required, and the top face of the cap 50 could similarly have an indentation to accentuate the recess 5 and its characteristics.

FIG. 9, shows the ability to dispose the plugs 15 and 19 within the associated holes provided on the bottom face of the cap 50 as set forth earlier embodiment.

Moreover, it should be appreciated that numerous structural modifications are contemplated as being a part of this inventin as set forth hereinabove and as defined hereinbelow by the claims.

What is claimed is:

1. An orthotic appliance having a forward to rear lengthwise axis and adapted to be placed as an insert within a boot, shoe or the like, said appliance comprising:

(a) An upper substantially continuous surface portion adapted to engage a lower surface of a foot, (b) a lower relatively resilient main body portion which extends beneath the foot, (c) said main body portion having at a rear part thereof upstanding edge portions to engage lower rear side portions of the foot, (d) the rear part of the main body portion having at a lower surface thereof a lengthwise extending recessed area with side strips positioned on opposite sides of said recessed area and protruding downwardly from said recessed area, (e) said appliance being characterized in that when a downward force is applied by a heel portion of the foot downwardly on a rear upper middle surface area of the appliance, the recessed area deflects downwardly in a manner that the upstanding edge portions grip the lower rear side portions of the foot, whereby when weight is transferred initially to the heel portion of the foot and then toward a middle portion of the foot during a gait cycle, proper lateral support of the foot is provided by the upstanding edge portions.

2. The appliance as recited in claim 1, wherein said recessed area extends substantially from a calcaneal area of the foot up to a cuboid and lateral metatarsal area.

3. The appliance as recited in claim 2, wherein said appliance is provided with opening means at a selected location in which is positioned plug means having a hardness greater than that of the main body portion of the appliance, whereby increased support is provided at said selected location.

4. The appliance as recited in claim 3, wherein said opening means and said plug means is located at at least one of said side strips, whereby an angular position of the foot can be more closely controlled.

5. The appliance as recited in claim 3, wherein said opening means and said plug means are located in the body portion of the appliance so as to be adjacent a metatarsal area of the foot.

6. The appliance as recited in claim 3, wherein said appliance is provided with a marginal web portion which is removable from said appliance, with said marginal web portion containing said plug means which can then be inserted in the opening means.

7. The appliance as recited in claim 1, wherein said appliance is provided with opening means at a selected location in which is positioned plug means having a hardness greater than that of the main body portion of the appliance, whereby increased support is provided at said selected location.

8. The appliance as recited in claim 7, wherein said opening means and said plug means is located at at least one of said side strips, whereby an angular position of the foot can be more closely controlled.

9. The appliance as recited in claim 7, wherein said opening means and said plug means are located in the body portion of the appliance so as to be adjacent a metatarsal area of the foot.

10. The appliance as recited in claim 7, wherein said appliance is provided with a marginal web portion which is removable from said appliance, with said marginal web portion containing said plug means which can then be inserted in the opening means.

* * * * *